US005796328A

United States Patent [19]

Golant

[11] Patent Number: 5,796,328

[45] Date of Patent: Aug. 18, 1998

[54] CONSUMER PRODUCT

[76] Inventor: Victor Golant, 114 E. 72 St., New York, N.Y. 10021

[21] Appl. No.: 672,236

[22] Filed: Jun. 28, 1996

[51] Int. Cl.[6] ..... G08B 3/00

[52] U.S. Cl. ..... 340/384.1; 340/328; 340/571

[58] Field of Search ..... 340/384.1, 384.5, 340/384.7, 326, 328, 286.11, 573, 565, 568, 571, 686

[56] References Cited

U.S. PATENT DOCUMENTS

| | | | |
|---|---|---|---|
| 2,038,625 | 4/1936 | Adler | 340/571 |
| 4,620,183 | 10/1986 | Kottelman | 340/568 |
| 4,733,675 | 3/1988 | Destro | 340/328 |
| 4,756,222 | 7/1988 | Armato | 340/328 |
| 4,847,589 | 7/1989 | Dobbins | 340/326 |
| 4,853,678 | 8/1989 | Bishop, Jr. et al. | 340/326 |
| 5,241,297 | 8/1993 | Goodman | 340/568 |
| 5,252,948 | 10/1993 | Goris et al. | 340/568 |
| 5,439,103 | 8/1995 | Howes | 340/384.7 |
| 5,464,092 | 11/1995 | Seeley | 340/384.7 |
| 5,548,272 | 8/1996 | Clark | 340/384.1 |

FOREIGN PATENT DOCUMENTS

| | | | |
|---|---|---|---|
| 0139876 | 5/1985 | European Pat. Off. | 340/384.1 |

*Primary Examiner*—Brent A. Swarthout
*Attorney, Agent, or Firm*—Ilya Zborovsky

[57] ABSTRACT

A consumer product has a main product part, an element for producing an audio message and attached to the main product part, an element for activating the audio message producing element and operable by a consumer, so that when the consumer operates the activating element, the activating element activate the audio message producing element to produce an audio message characterizing the consumer product and the consumer product manufacturer.

21 Claims, 5 Drawing Sheets

CONSUMER PRODUCT

BACKGROUND OF THE INVENTION

The present invention generally relates generally to consumer products.

It has been recognized that for many consumers who purchase consumer products in stores and the like it is sometimes difficult to obtain a sufficient information from the written messages provided on the products or their packages. The reasons are that some consumers have vision problems and experience difficulties with reading small print, other consumers are not familiar with the language in which the corresponding messages are written, many of the consumers are kids who have difficulties reading the messages or understanding their meaning, etc. It is therefore believed to be advisable to improve consumer products so that a consumer who intends to purchase a product can obtain all desired information about a product in a simple, reliable and accurate way.

SUMMARY OF THE INVENTION

Accordingly, it is an object of the present invention to provide a consumer product which avoids the disadvantages of the prior art.

More particularly, it is an object of the present invention to provide a consumer product which can deliver itself a message about its characteristics, properties, etc. in a simple, reliable and accurate manner which is easy to comprehend by consumers of any age, background and health condition.

In keeping with these objects and with others which will become apparent herein after, one feature of the present invention resides, briefly stated, in a consumer product which has a main product part, audio message producing means attached to the main product part and capable of delivering an audio message about the consumer product, and means activating the audio message producing means operable by a consumer, so that when the consumer operates the activating means the audio message producing means produce a message about the consumer product or a product manufacturer.

When the consumer product is designed in accordance with the present invention, it is not absolutely necessary to read the written information provided on the product or its package. Instead, a consumer operates the activating means which, in turn, activate the audio message producing means which produce an audio message about the product. Thereby every customer which, of course, is not hearing impaired, can obtain the information about the consumer product which he or she desires to determine whether to buy or not buy the corresponding product.

In accordance with other advantageous features of the present invention the activating means can be formed as sensors reacting to finger pressure, skin heat and other actions of the consumer, or even responding to the removal of the consumer product from the shelf, stand, suspending hook and the like be the consumer.

In accordance with still further features of the present invention, the audio message producing means can correspond to messages written on the consumer product, so that the consumer can listen to the audio message and simultaneously follow the written message. The audio message producing means also can produce a message which is different or supplemental to the written message provided on the consumer product.

The audio message producing means can be provided with a small power source, which can include for example a solar cell. The audio message producing means can produce a verbal message or a sound non-verbal message still recognizable by a consumer.

The novel features which are considered as characteristic for the present invention are set forth in particular in the appended claims. The invention itself, however, both as to its construction and its method of operation, together with additional objects and advantages thereof, will be best understood from the following specification and description of specific embodiments when read in connection with the accompanying drawing.

DESCRIPTION OF THE PREFERRED EMBODIMENTS

Figure 1:
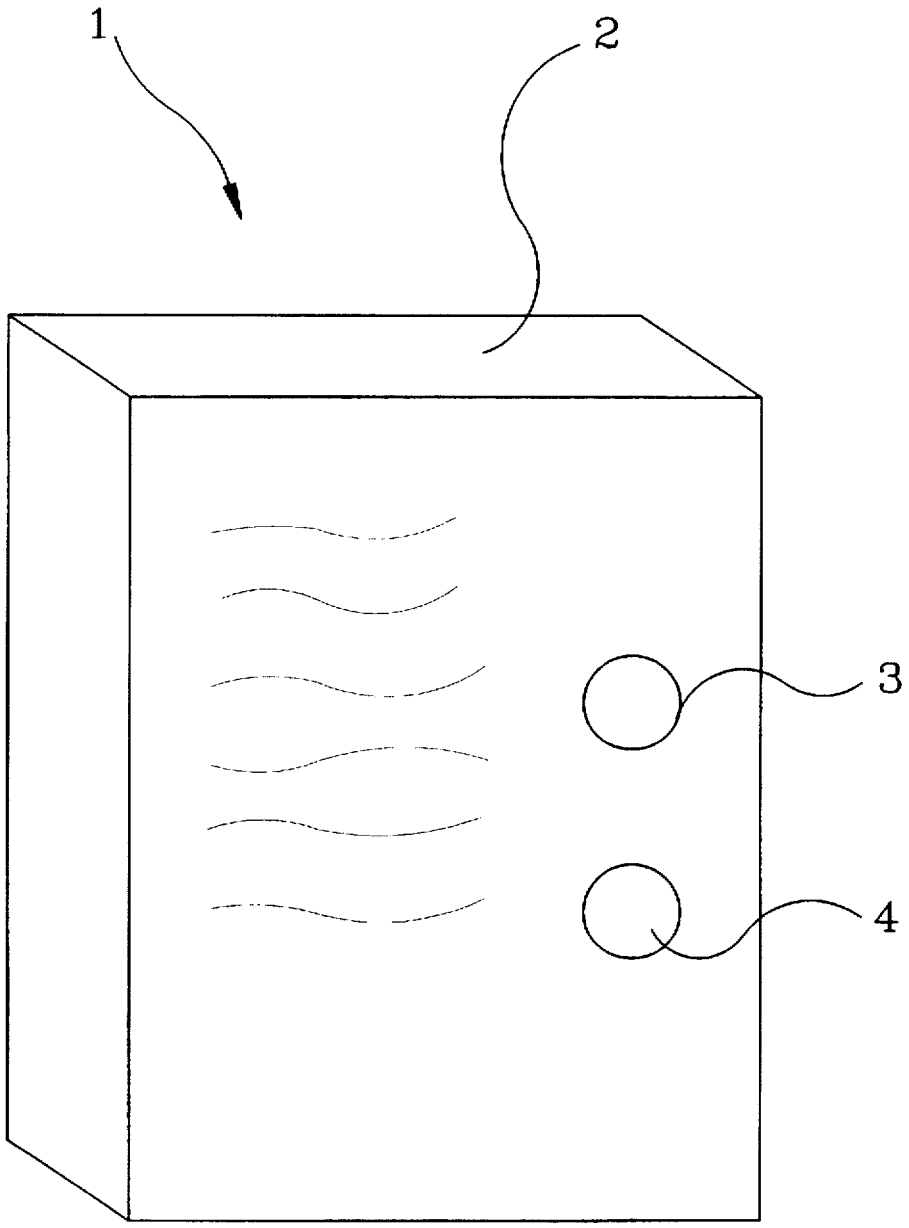
FIG. 1 is a perspective view schematically showing one type of a consumer product in accordance with the present invention.

A consumer product of one type in accordance with the present invention is identified as a whole with reference numeral 1 and illustrated by way of example as a box of cereal. The consumer product in accordance with the present invention has a main product part which is identified with reference numeral 2 and in the shown embodiment is formed by a hollow box with an inner chamber filled with cereal. The inventive consumer product further has audio message producing means. The audio message producing means is identified as a whole with reference numeral 3 as will be explained in detail herein below. The inventive consumer product further has activating means identified as a whole with reference numeral 4 and operative for activating the audio message producing means 3 as also will be explained in detail herein below.

Figure 3:
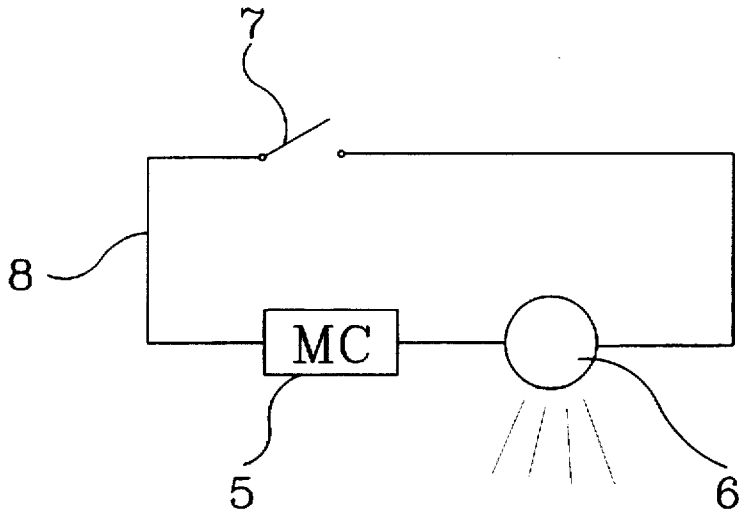
FIG. 3 is a view schematically showing an electronic circuit of the inventive consumer product of FIG. 1.
Figure 4:
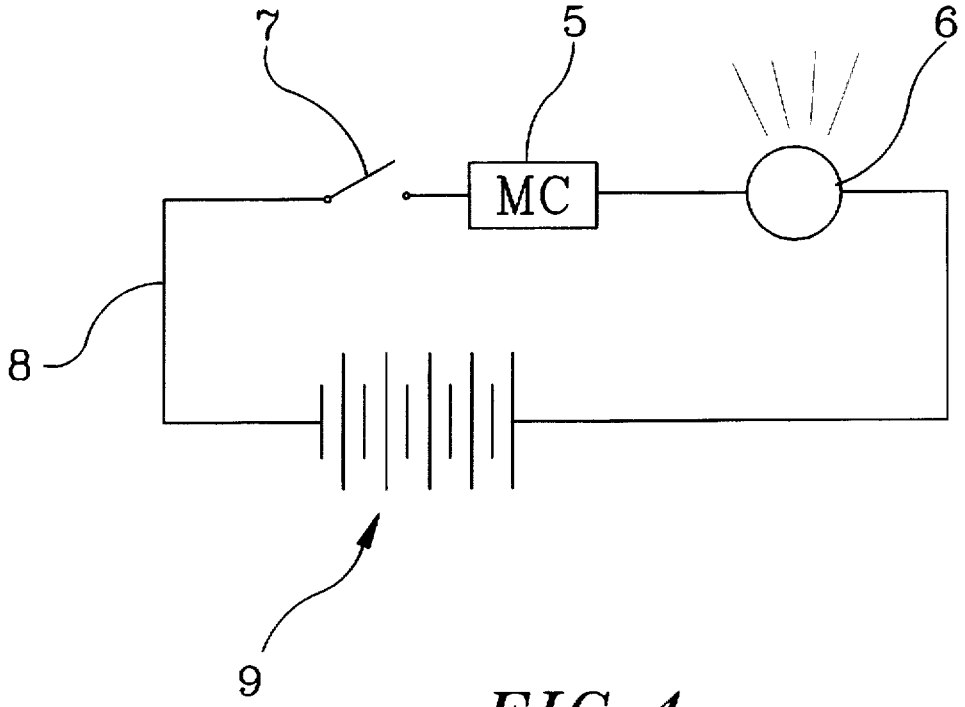
FIG. 4 is a view showing the electronic circuit of the inventive consumer product of FIG. 1 in accordance with another embodiment.

The audio message producing means can include a microchip 5 shown in FIG. 3 and connected with a speaker 6. The activating means can be formed as a switch 7 connected with the microchip and the speaker in a single circuit 8. In the embodiment shown in FIG. 3 the microchip is provided with a not shown power source. In contrast, in the embodiment shown in FIG. 4 an additional micro power source 9, for example a solar cell, is provided in the circuit 8.

Figure 5:
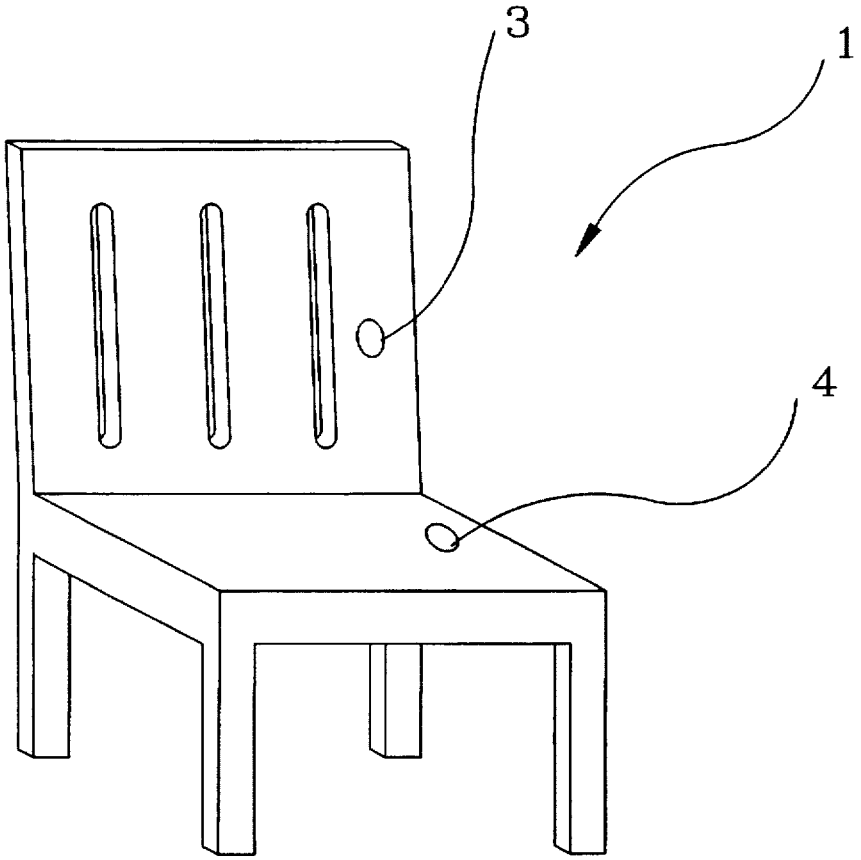
FIG. 5 is a view showing the consumer product of FIG. 1 in accordance with still further embodiment of the present invention.

The audio message producing means, or more particularly the microchip element 5 or its equivalent element, can be firmed so that it produces a message characterizing the consumer product. In particular, the audio message can include information about the name of the product, its properties, its characteristics, its caloric content, its fat content, its price, its manufacturer, etc. The audio message produced by the audio message producing means can correspond to the written text on the consumer product, so that a consumer can listen to the audio message and simultaneously read the written message on the consumer product itself to better understand the latter. On the other hand, the audio message produced by the audio message producing means can be different from the message written on the consumer product or supplementary to this message, so as to supplement the information provided by the text written on the consumer product. It is of course to be understood that the audio message producing means and the activating means can be mounted either on the consumer product, or on its packaging. FIG. 1 specifically shows that these means are provided on the packaging, in other words on the box which accommodates the cereal. However, the same means can be mounted directly on the consumer product, such as, for example, on articles of furniture, articles of clothing, etc. This option is shown in FIG. 5 in which the audio message producing means 3 and the activating means 4 are mounted directly on the corresponding surfaces of the chair.

Figure 2:
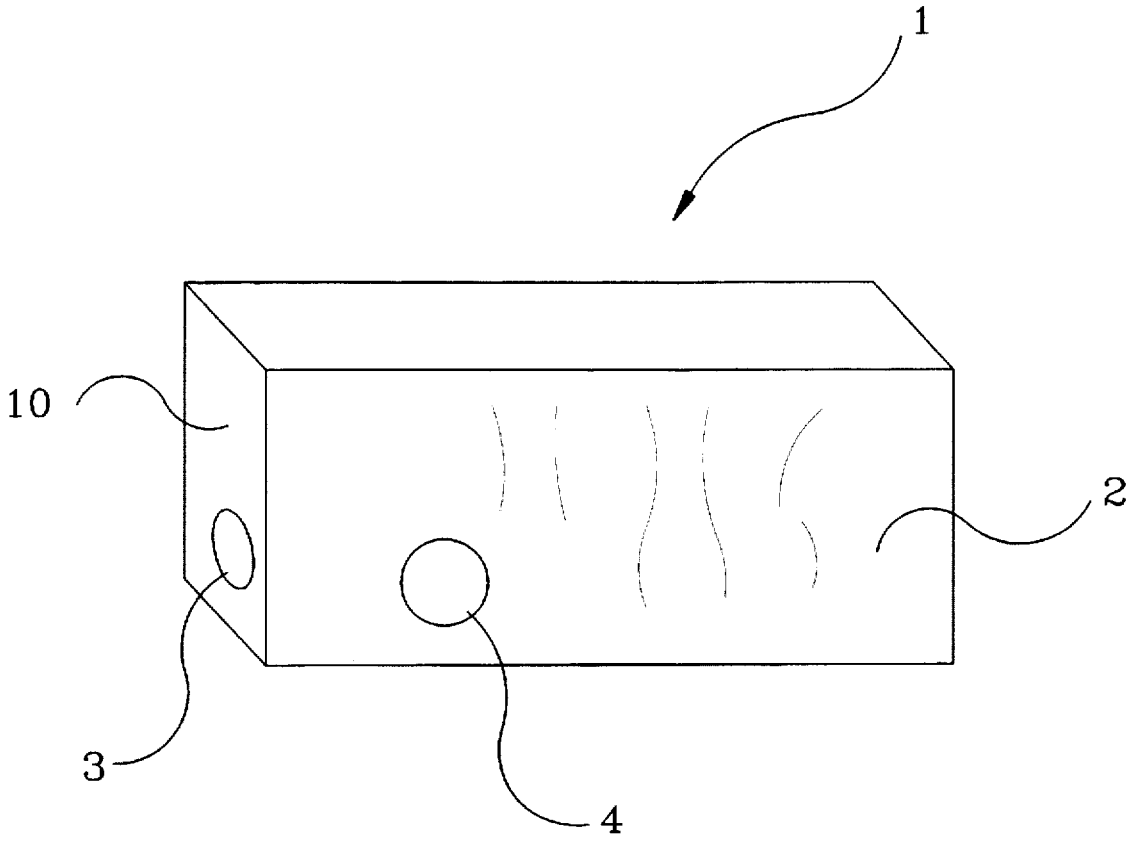
FIG. 2 is a view showing a consumer product of FIG. 1 in accordance with another embodiment of the present invention.

As shown in FIG. 1, the audio message producing means or in particular its outlet element, such as the speaker 6, and the activating means, in particular the switch 7, can be mounted on the same surface of the consumer product. The switch 7 can be formed as a part of a sensor operable by a consumer. It can be a pressure sensor operable by finger pressure of the consumer, a heat sensor operable in response to a finger touch and application of skin heat, etc. In accordance with the embodiment shown in FIG. 2, the sensor or the switch is located on a standing surface 10 of the consumer product. It formed so that when the consumer product stands on a shelf and the like with the standing surface 10, the switch and the activating means 3 is inoperative. However, when a consumer takes the consumer product from the shelf, the switch 7 closes the circuit 8 and activates the audio message producing means.

On the other hand, with the switch 7 arranged on the standing surface 10, the audio message producing means can be designed in a different way. When the consumer product stands with the standing surface 10 of the shelf and the like, no audio message is produced. In order to produce the audio message the consumer presses the consumer product downwards so as to apply pressure on the switch 7 by the shelf surface, and thereafter the switch 7 closes the circuit 8 and activates the audio message producing means.

Figure 6:
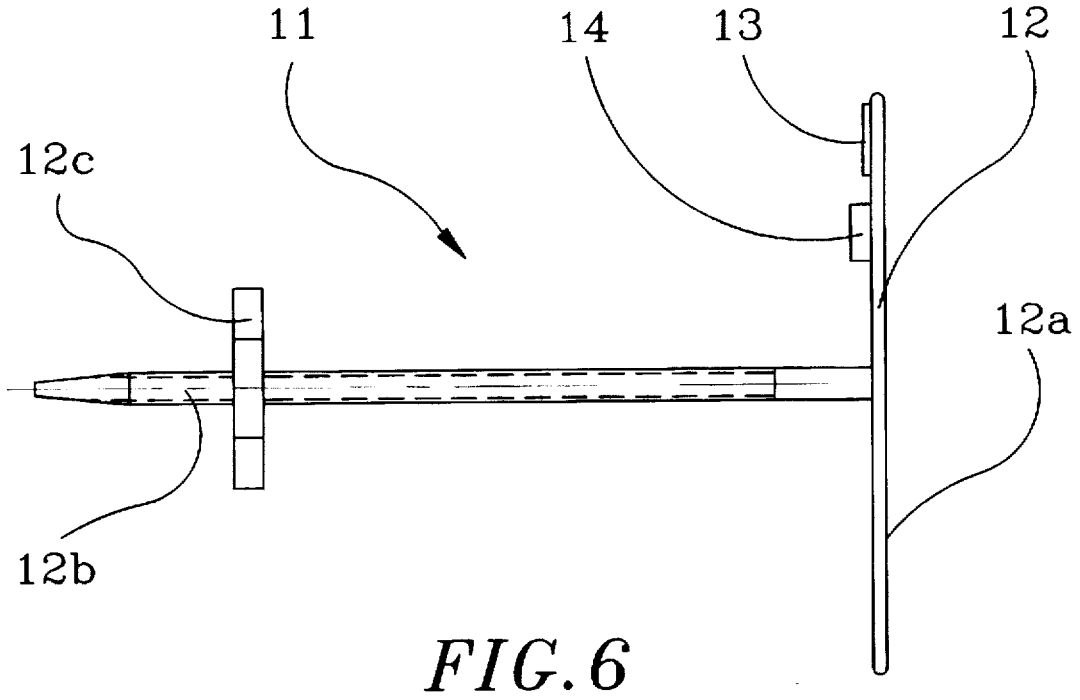
FIG. 6 is a side view of another type of the inventive consumer product.
Figure 7:
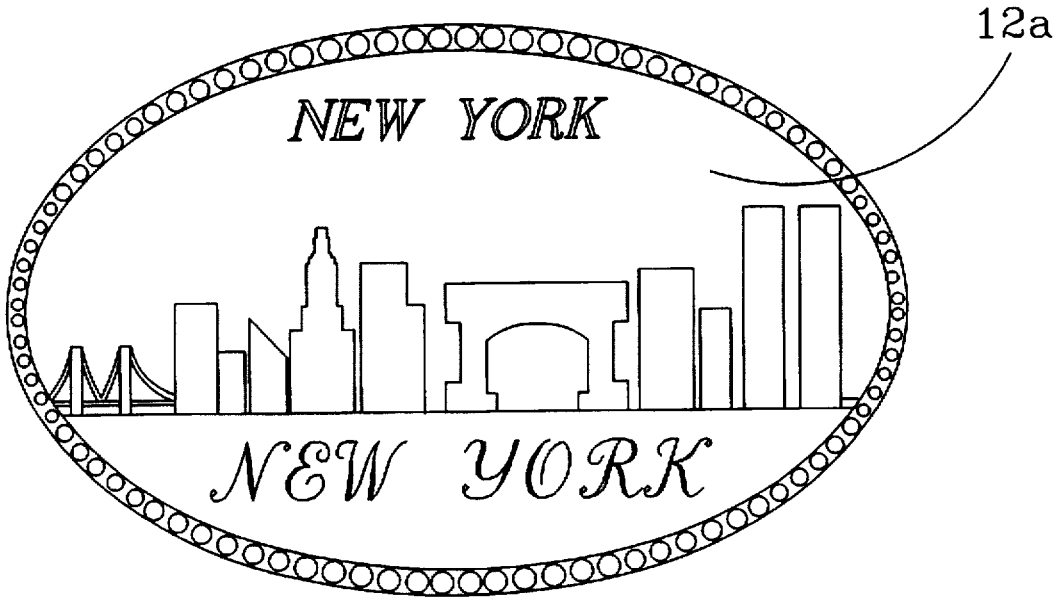
FIG. 7 is a front view of the consumer product of FIG. 6.

A consumer product of another type in accordance with the present invention is shown in FIGS. 6 and 7. It is formed, for example, as a badge for general population for tourists, for museum visitors, and the like, and identified with reference numeral 11. The product part 12 including an image carrying plate 12*a*, a pin 12*b* having a threaded end portion, and a threaded disc 12*c* screwable onto the pin after it has pierced a part of the user's clothes, to hold the badge on the clothes. The image on the carrying plate 12*a* can be, for example, an image of a tourist attraction, such as Empire State Building in New York, etc.

The consumer product 11 further has audio message producing means 13 and activating means 14 for activating the audio message producing means. The audio message producing means 13 can produce an audio message corresponding to the image on the carrying plate 12*a* of the main product part 12, for example an audio information about the Empire State Building in the shown example, in a language which is familiar to the corresponding tourist and the like. When the tourist activates the audio message producing means he or she hears the message in his or her mother's tongue.

It is to emphasize that the present invention deals with articles which do not inherently have audio messages as a main part. The novelty of the present invention is a consumer product which has the main part and might have additionally only a video or visual message. It is also the important feature of the present invention that the audio message producing means produce the audio messages limited exclusively to the characteristics of the product and/or the product manufacturer, in contrast for example to "music card" which generates a greeting message etc., which does not describe either the product or the manufacturer.

It will be understood that each of the elements described above, or two or more together, may also find a useful application in other types of construction differing from the types described above.

While the invention has been illustrated and described as embodied in a consumer product, it is not intended to be limited to the details shown, since various modifications may be made without departing in any way from the spirit of the present invention.

Without further analysis, the foregoing will so fully reveal the gist of the present invention that others can, be applying current knowledge, readily adapt it for consumer products without omitting features that, from the standpoint of prior art, fairly constitute essential characteristics of the generic or specific aspects of this invention.

What is claimed as new and desired to be protected by Letters Patent is set forth in particular in the appended claims:

1. A consumer product, comprising a main product part; means for producing an audio message and attached to said main product part: an activating means for activating said audio message producing means and operable by a consumer, so that when the consumer operates said activating means, said activating means activate said audio message producing means to produce an audio message related to the consumer product and corresponding to written text on the product in response to a change in interaction of said main product part as a whole with a support on which said main product part is supported as a whole.

2. A consumer product as defined in claim 1, wherein said activating means is formed as means responding to an action applied by the consumer.

3. A consumer product as defined in claim 1, wherein said activating means is formed so as to activate said audio message producing means in response to a removal of said main product part as a whole from a support on which said main product part is supported as a whole.

4. A consumer product as defined in claim 1, wherein said activating means is formed so as to activate said audio message producing means in response to applying a pressure by said main product part as a whole against a support on which said main product part is supported as a whole.

5. A consumer product as defined in claim 1, wherein said audio message producing means include a micro electronic element generating the audio message and a speaker emitting the generated audio message.

6. A consumer product as defined in claim 5, wherein said micro electronic element includes a power source.

7. A consumer product as defined in claim 5, wherein said audio message producing means additionally include a power source.

8. A consumer product as defined in claim 1, wherein said main product part has a plurality of surfaces, said audio message producing means and said activating means being arranged on one of said surfaces.

9. A consumer product as defined in claim 1, wherein said main product part has a plurality of surfaces, said audio message producing means and said activating means being arranged on different ones of said surfaces.

10. A consumer product as defined in claim 1, wherein said main product part has a product and a packaging containing the product, said means being arranged on the packaging.

11. A consumer product as defined in claim 1, wherein said main product part is a product itself, said means being arranged on said product itself.

12. A consumer product as defined in claim 1, wherein said main product part has a video message, said audio message producing means producing an audio message which corresponds to said video message.

13. A consumer product as defined in claim 1, wherein said main product part has a video message, said audio message producing means producing an audio message which is different from said video message.

14. A consumer product as defined in claim 1, and further comprising a power source formed as a solar cell.

15. A consumer product as defined in claim 1, wherein said audio message producing means produce an audio message characterizing the consumer product.

16. A consumer product as defined in claim 1, wherein said audio message producing means produce an audio message characterizing a consumer product manufacturer.

17. A consumer product as defined in claim 3, wherein said main product part has a standing surface with which it stands on a support, said activating means being arranged on said standing surface, so that said activating means activate said audio message producing means in response to a removal of said standing surface of said main product part as a whole from said support on which said standing surface of said main product part is supported.

18. A consumer product as defined in claim 4, wherein said main product part has a standing surface with which it stands on the support, said activating means being arranged on said standing surface so that said activating means activate said audio message producing means in response to applying a pressure by said main product part as a whole, so that said standing surface and thereby said activating means arranged on said standing surface are pressed against the support on which said standing surface of said main part is supported.

19. A consumer product as defined in claim 17, wherein said support is a shelf, said activating means being arranged on said standing surface, so that said activating means activate said audio message producing means in response to a removal of said standing surface of said main product part as a whole from said shelf on which said standing surface of said main product part is supported.

20. A consumer product as defined in claim 18, wherein said wherein said support is a shelf, said activating means being arranged on said standing surface so that said activating means activate said audio message producing means in response to applying a pressure by said main product part as a whole, so that said standing surface and thereby said activating means arranged on said standing surface are pressed against the shelf on which said standing surface of said main part is supported.

21. A consumer product, comprising a main product part; means for producing an audio message and attached to said main product part: an activating means for activating said audio message producing means and operable by a consumer, so that when the consumer operates said activating means, said activating means activate said audio message producing means to produce an audio message related to the consumer product and corresponding to written text on the product in response to a change in interaction of said consumer product as a whole with a support on which the consumer product is supported as a whole.

* * * * *